US005427275A

United States Patent [19]

Hansen

[11] Patent Number: 5,427,275

[45] Date of Patent: Jun. 27, 1995

[54] DISPENSER CAP WITH PIERCER

[76] Inventor: Bernd Hansen, Heerstrasse 16, D-74429 Laufen, Germany

[21] Appl. No.: 343,968

[22] Filed: Nov. 18, 1994

Related U.S. Application Data

[63] Continuation-in-part of Ser. No. 113,082, Aug. 30, 1993.

[30] Foreign Application Priority Data

Sep. 26, 1992 [DE] Germany ..... 42 32 305.3

[51] Int. Cl.[6] ..... B67D 5/00

[52] U.S. Cl. ..... 222/83; 222/91; 222/420

[58] Field of Search ..... 222/83, 83.5, 89, 91, 222/420, 421, 422; 83/684

[56] References Cited

U.S. PATENT DOCUMENTS

| | | | |
|---|---|---|---|
| 1,160,883 | 11/1915 | Hamer | 222/422 |
| 2,008,807 | 7/1935 | Williams | 222/82 |
| 2,173,662 | 9/1939 | Platlring | 222/420 |
| 2,295,865 | 9/1942 | Rentschler | 222/541 |
| 2,800,253 | 7/1957 | Henderson | 604/298 |
| 2,987,223 | 6/1961 | Arnour | 222/420 |
| 3,325,860 | 6/1967 | Hansen | 264/524 |
| 3,731,848 | 5/1973 | Nakanishi | 222/420 |
| 3,777,949 | 12/1973 | Chiquiari-Arias | 222/541 |
| 3,926,339 | 12/1975 | Openchowski | 222/83 |
| 4,157,765 | 6/1979 | Galehiewsky | 222/541 |
| 4,234,103 | 11/1980 | Strohl | 222/420 |
| 4,358,028 | 11/1982 | Chiquiari-Arias | 222/541 |
| 4,425,090 | 1/1984 | Hansen | 264/525 |
| 4,566,613 | 1/1986 | Anscomb | 222/541 |
| 4,584,823 | 4/1986 | Nagel | 264/524 |
| 4,688,703 | 8/1987 | Bayer | 222/541 |
| 4,707,966 | 11/1987 | Weiler | 264/524 |
| 4,787,536 | 11/1988 | Winderstrom | 222/541 |
| 4,884,705 | 12/1989 | Debetencourt | 222/83 |
| 5,076,974 | 12/1991 | Hansen | 222/420 |

FOREIGN PATENT DOCUMENTS

| | | | |
|---|---|---|---|
| 2622795 | 5/1989 | France | 222/420 |
| 2636926 | 3/1990 | France | 222/420 |
| 2446564 | 4/1978 | Germany . | |
| 3033821 | 4/1982 | Germany . | |
| 3735909 | 5/1989 | Germany . | |
| 622679 | 6/1961 | Italy | 222/83.5 |
| 347763 | 8/1960 | Switzerland . | |

*Primary Examiner*—Gregory L. Huson

*Attorney, Agent, or Firm*—Roylance, Abrams, Berdo & Goodman

[57] ABSTRACT

A cap for receptacles, particularly bottles made of plastic in a blow molding process which are filled and closed in the blow mold and which have a bottle neck, is placed on the bottle neck. The cap has, adjoining the section for receiving the neck, a section which forms one piece with the neck receiving section and which is designed as a dropper or other dispenser and a piercer.

17 Claims, 2 Drawing Sheets

DISPENSER CAP WITH PIERCER

REFERENCE TO RELATED APPLICATION

This application is a continuation-in-part of U.S. patent application Ser. No. 08/113,082 of Bernd Hansen, filed on Aug. 30, 1993, the subject matter of which is hereby incorporated by reference.

FIELD OF THE INVENTION

The present invention relates to a cap for receptacles, particularly bottles made of plastic in a blow molding process in which the bottles are filled and closed in the blow mold and have a neck on which the cap is placeable. The cap includes a dispenser for the bottle contents, and a piercer for opening a closure.

BACKGROUND OF THE INVENTION

Plastic bottles, with a neck and an outer thread on the neck, can be closed at the free end of the neck by a closure forming one piece with the neck. A piercer for piercing the closure is conventionally provided on the inside and at the center of a cap screwed onto the neck. When the cap is removed after the piercing of the closure, the liquid in the bottle can then be delivered through the opening formed in the closure by the piercer.

A thread on the bottle neck and/or on the cap in not being of optimum shape, or the piercer in not being of optimum shape can cause the opening made by the piercer to extend at an incline to the longitudinal axis. Additionally, after removal of a partial amount and subsequent screwing-on of the cap, a second opening can be pierced. The inclined and/or multiple piercing results in the liquid flowing out in a direction deviating from the longitudinal axis, possibly at several points, which is troublesome. The pressure exerted on the liquid determines whether the liquid is delivered in larger or smaller drops or in the form of a jet. Furthermore, the size of the opening may change in the course of time if, after removal of a partial amount of the contents of the bottle, the neck is closed again by the cap and the piercer is introduced into the opening again.

Therefore, obtaining the correct dosage of the amount to be removed is difficult.

Additionally, conventional dispensing caps with piercers have flow channels extending in different directions which are difficult to form and require complex molds.

SUMMARY OF THE INVENTION

Objects of the present invention involve providing a cap for a receptacle enabling problem-free removal of the liquid contents of the receptacle either in the form of single drops of a defined size or in the form of a jet.

Other objects of the present invention involve providing a dispenser cap with a piercer which is simple and economical to form.

The foregoing objects are obtained by a cap for receptacles, particularly bottles made of plastic in a blow molding process which are filled and closed in a blow mold and have a bottle neck. The cap comprises a first section having coupling means for receiving the bottle neck, and a second section formed as one piece with the first section and having dispensing means. The second section has an inside end face and a piercer tapering from the inside end face. The piercer has a circumferential surface and a pointed tip extending inside the first section. A flow channel extends through the dispensing means and the piercer, and includes an intermediate section having a substantially constant cross-sectional configuration and an end section which opens on the circumferential surface. The intermediate section extends along a first longitudinal axis. The end section extends from the intermediate section and along a second longitudinal axis parallel to the first longitudinal axis, and has a cross-sectional configuration wholly within an axial extension of the cross-sectional configuration of the intermediate section.

With the second section of the cap of the present invention being designed as a dropper or other dispenser, the dosing during delivery of the liquid contents of the bottle is not carried out or controlled by an opening formed by the bottle neck. The dosing is controlled by the dropper or other dispenser of the cap. This dropper or dispenser can be designed without any problems such that, independently of the prevailing pressure, the dropper or dispenser forms drops of a reproducible size and reliably excludes delivery in the form of a jet, or brings about delivery in the form of a jet.

The bottle closure can be pierced by the piercer as in the known caps having a piercer. As the dropper or dispenser carries out the dosing, the opening need not be formed exactly at the center and coaxially in the closure and its size can deviate from the set value.

In order that the piercer can have a sharp point, the flow channel end section leads into or opens on the circumferential surface of the piercer. The end section comes to rest within the bottle neck when the cap is screwed completely onto the neck. With the end section extending parallel to the intermediate section and having a cross-sectional configuration wholly within an axial extension of the cross-sectional configuration of the intermediate section, the entire flow channel can be simply and reliably formed by a single, axial movable member without any relatively movable parts, such as a calibrating mandrel.

Very good reproducibility of the drop size and reliable prevention of jet-shaped delivery of the bottle contents are achieved with a flow channel of the dispenser in which a section expands conically in the discharge direction and adjoins a cylindrical section. These sections are preferably calibrated during manufacture by a calibrating mandrel.

The cap can be arranged on the neck with a close sliding fit. However, the section of the cap receiving the neck will be provided with an inner thread which corresponds in design to an outer thread on the bottle neck.

In a preferred embodiment, a closure part is removably placed on the cap section designed as dropper. The closure part is provided to protect the flow channel of the dropper. This closure is preferably designed as a pot-shaped hood with an inner thread corresponding to and mating with an outer thread on the cap section designed as dropper. A plug which is sealingly introducible into the flow channel of the dropper can be formed at the center of the inside surface of the bottom of this hood.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
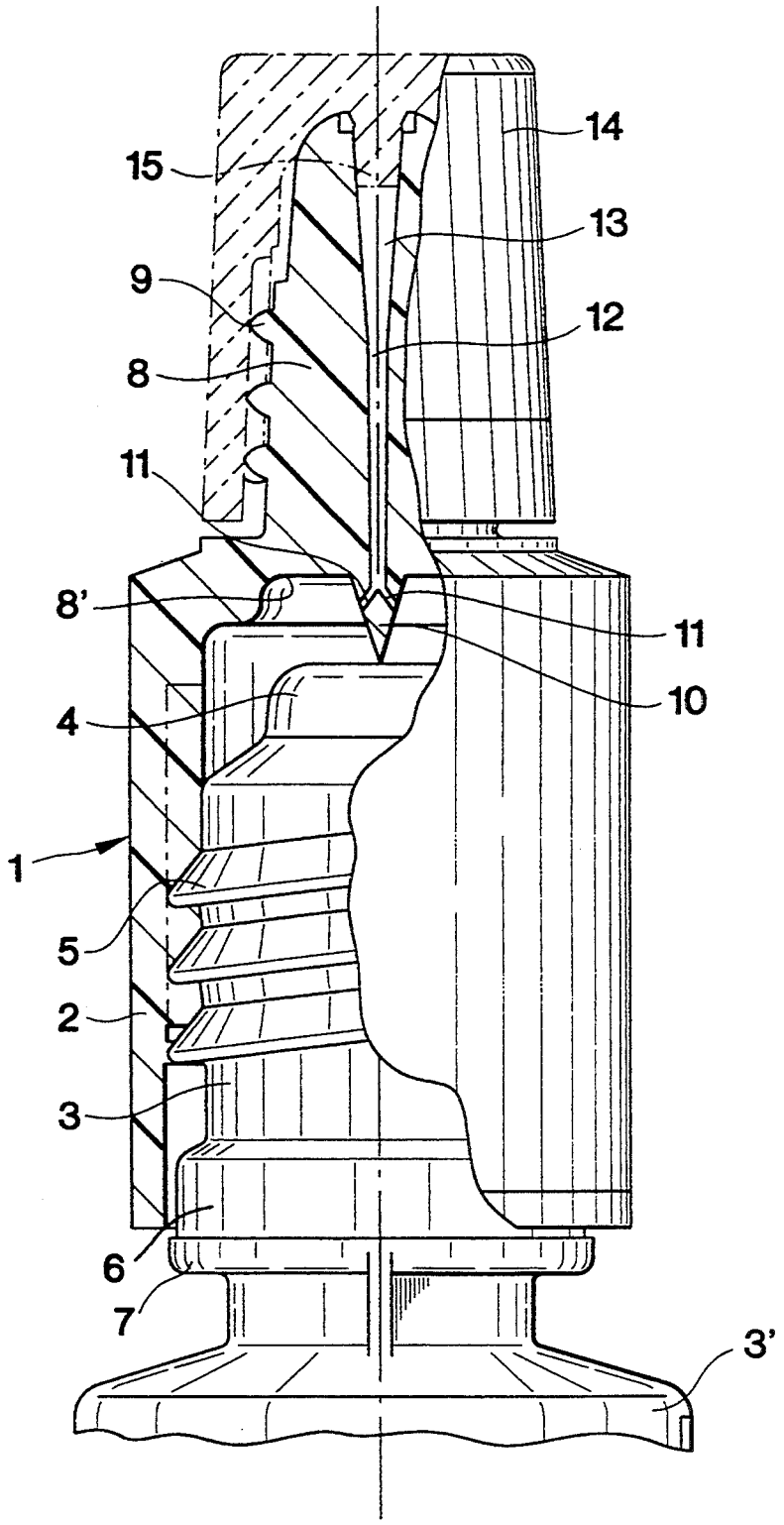
FIG. 1 is an enlarged side elevational view, partially in section, of a cap according to a first embodiment of the present invention, illustrating the cap placed on the neck of a bottle before piercing of the closure of the neck.

As illustrated in FIG. 1, the plastic cap of the first embodiment of the present invention, designated in its entirety as 1, comprises a first, hollow, cylindrical section 2 receiving neck 3 of a bottle. In the illustrated embodiment, the bottle is made from plastic in a blow molding process and filled and closed in the blow mold. The bottle is formed with a plate-shaped closure 4 closing neck 3 and formed unitarily, as one piece with the neck 3, and can be an ampule.

Neck 3 of the bottle is provided with an outer thread 5. Between bottle body 3' and the end of outer thread 5, but lying closer to or adjacent outer thread 5, neck 3 has a cylindrical section 6. The outer diameter of neck cylindrical section 6 is chosen such that it is identical with that of the outer thread 5. Adjoining the end of neck cylindrical section 6 facing the bottle body 3' is a toroidal ring 7. Ring 7 projects radially outwardly to a slight extent over or beyond cylindrical section 6. The outer diameter of toroidal ring 7 is slightly larger than the inner diameter of the zone forming the free end of first section 2.

Section 2 is provided with an inner thread which corresponds to and mates with outer thread 5 of neck 3. The inner thread does not extend into the zone forming the free end section.

Adjoining section 2, on the side facing away from the bottle body 3' is a second section of the cap designed as a dispenser in the form of a dropper 8. Dropper 8 has the same longitudinal axis as section 2, and is formed unitarily as one piece with section 2. The section designed as dropper 8 is provided with an outer thread 9. The free end of dropper 8 is rounded off to define semispherical shape.

A conical piercer 10 is formed at the center of the inside end face 8' of the dropper 8. Inside end face 8' is at the transition from section 2 to dropper 8. The tip of piercer 10 points into the interior of section 2.

Except for end sections 11 of the flow channel extending through the dropper 8, the dropper flow channel has the same axis as the piercer 10. End sections 11 lead into the circumferential surface of piercer 10. Joining end sections 11, the flow channel has a cylindrical middle section 12 connecting the end sections to a conical section 13. Conical section 13 expands to the semispherical end of the dropper 8. Both the middle section 12 and the conical section 13 are calibrated during manufacture by a calibrating mandrel.

As illustrated in FIG. 1, the transverse cross-sectional diameter of the middle section 12 is considerably smaller than its axial length. This characteristic also applies to the conical section 13 which has a relatively small cone angle. In the illustrated embodiment, the cone angle is approximately 8°.

The design of the flow channel, particularly its two sections 12 and 13, may be different. The design depends on the characteristics of the liquid, for example, its viscosity and surface tension, as well as the size of the drops, and on whether delivery is desired in the form of drops or a jet.

A pot-shaped protective hood 14, like the cap 1, is formed of plastic. The hood covers dropper 8. The protective hood 14 is provided with an inner thread corresponding to and mating with outer thread 9 of dropper 8, and extends almost as far as the outside shoulder of cap 1 formed at the transition from section 2 to dropper 8. A plug 15 is integrally formed at the center of the bottom or closed end of the protective hood 14, on the inside, surface of the closed end. The plug 15 engages and is received in conical section 13 and seals the conical section when the protective hood 14 is fully screwed onto the dropper 8.

If the bottle is marketed with cap 1, cap 1 is screwed onto bottle neck 3 until the free end of section 2 extends as far as toroidal ring 7 of neck 3, as illustrated in FIG. 1. This position is easily recognized by the fact that when cap 1 is screwed further onto bottle neck 3, section 2 comes into contact with the toroidal ring 7, and hence an increased torque has to be applied. When cap 1 is screwed onto bottle neck 3 as far as toroidal ring 7, piercer 10 is in contact with or almost in contact with bottle closure 4.

When the contents of the bottle are to be removed, cap 1 is screwed fully onto the neck 3. As piercer 10 pierces bottle closure 4 and the toroidal ring 7 is overcome, a clearly discernible increased torque has to be applied. The increased torque does not create any difficulties because of the longitudinal ribbing on the outside circumferential surface of section 2. When piercer 10 has completely pierced bottle closure 4, the outer end face of the bottle closure rests against end face 8' of dropper 8 carrying piercer 10. In this position, end sections 11 of the flow channel of the dropper extend into the interior of the neck 3. Protective hood 14 now only needs to be screwed off of dropper 8 to enable removal of the contents of the bottle in the form of single drops of a defined, reproducible size. However, if the flow channel is designed for delivery of the liquid in the form of a jet of a defined size, the liquid is delivered in the form of a jet.

Figure 2:
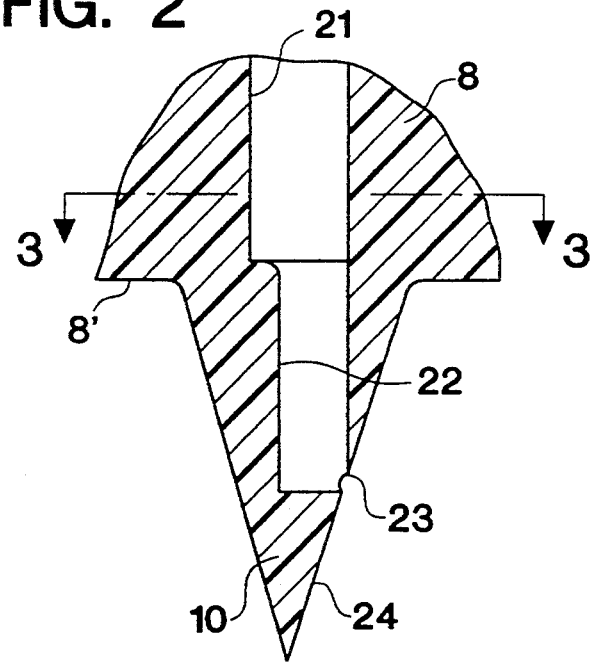
FIG. 2 is an enlarged, partial side elevational view in section of a cap according to a second embodiment of the present invention.
Figure 3:
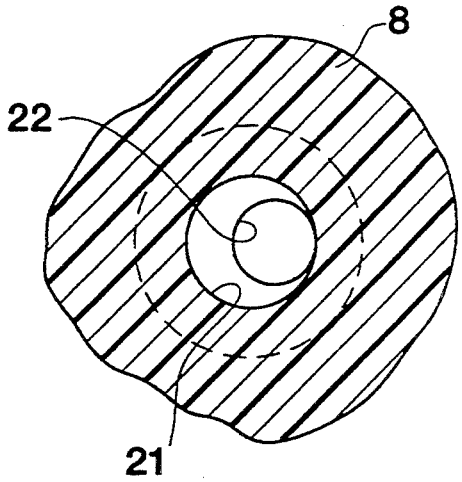
FIG. 3 is a top plan view of the cap taken along line 3—3 of FIG. 2.

FIGS. 2 and 3 illustrate a cap dropper 8 with conical piercer 10 having a flow channel according to a second embodiment of the present invention. In this second embodiment, the flow channel has a flow channel intermediate section 21 in the form of a constant right circular cylinder extending along a longitudinal axis which is coaxial with the longitudinal axes of the cap and piercer. Section 21 terminates just above inside end face 8', and corresponds to section 12 of the first embodiment. A end section 22, in the form of a right circular cylinder extends from section 22 as a direct and straight prolongation of section 21, but with a small cross-sectional configuration. Specifically, section 22 has a smaller transverse cross-sectional diameter than section 22, and a cross-sectional configuration wholly within an axial extension of the cross-sectional configuration of section 21. The longitudinal axis of section 22 is laterally spaced from and is parallel to the longitudinal axis of section 21 such that sections 21 and 22 are eccentrically offset. Section 22 forms an opening 23 on side or circumferential surface 24 of piercer 10, spaced from the piercer tip.

Figure 4:
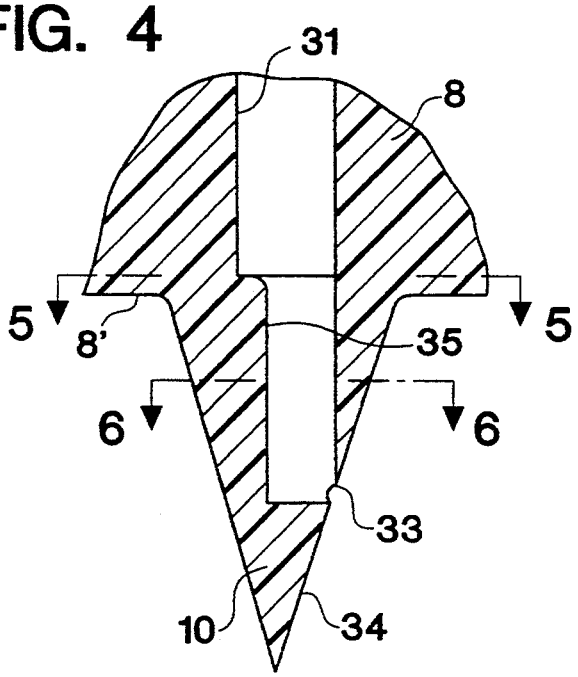
FIG. 4 is an enlarged, partial side elevational view in section of a cap according to a third embodiment of the present invention.
Figure 5:
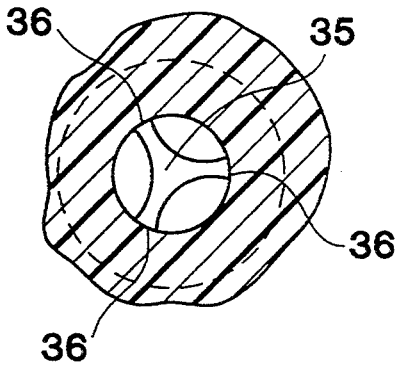
FIG. 5 is a top plan view of the cap taken along line 5—5 of FIG. 4.
Figure 6:
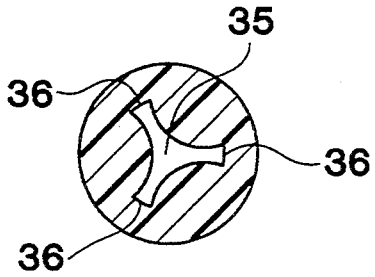
FIG. 6 is a top plan view of the cap taken along line 6—6 of FIG. 4.

FIGS. 4–6 illustrate cap dropper 8 with conical piercer 8 having a flow channel according to a third embodiment of the present invention. In this third embodiment, flow channel intermediate section 31 is in the form of a constant right circular cylinder extending along a longitudinal axis which is coaxial with the longitudinal axes of the cap and piercer. Section 31 terminates just above inside end face 8', and corresponds to section 12 of the first embodiment. An end section 35, having a substantially constant cross-sectional configuration of a three-pointed star, extends coaxially from and as a prolongation of section 31. Each of the three portions 36 of end section 35 extends radially outwardly from a central portion terminating inside said piercer to form three spaced apart openings 33 on side or circumferential surface 34 of piercer 10, spaced from the piercer top. Portions 36 are angularly offset by equal angles to space openings 33 equally. The cross-sectional configuration of end section 35 is wholly or entirely within an axial extension of the circular cross-sectional configuration of section 31.

The flow channels at FIGS. 2–6 can be simply and accurately formed by a one-piece calibrating mandrel. This mandrel need only be moved axially within the mold forming the cap. A mandrel with multiple movable parts or a multiple step forming process is not required.

While various embodiments have been chosen to illustrate the invention, it will be understood by those skilled in the art that various changes and modifications can be made therein without departing from the scope of the invention as defined in the appended claims.

What is claimed is:

1. A cap for receptacles, particularly bottles made of plastic in a blow molding process which are filled and closed in a blow mold and have a bottle neck, the cap comprising:

a first section having coupling means for receiving the bottle neck;

a section formed as one piece with said first section and having dispensing means, said second section having an inside end face and a piercer tapering from said inside end face, said piercer having a circumferential surface and a pointed tip extending inside said first section; and a flow channel extending through said dispensing means and said piercer, said flow channel including an intermediate section having a substantially constant cross-sectional configuration and at least one end section which opens on said circumferential surface, said intermediate section extending along a first longitudinal axis, said end section extending from said intermediate section and along a second longitudinal axis parallel to said first longitudinal axis, said end section having a cross-sectional configuration wholly within an axial extension of said cross-sectional configuration of the intermediate section.

2. A cap according to claim 1 wherein said piercer extends along a piercer longitudinal axis which is substantially coaxial with said first longitudinal axis.

3. A cap according to claim 2 wherein said circumferential surface is conical between said pointed tip and said inside end face.

4. A cap according to claim 1 wherein said intermediate section and said end section are symmetrical relative to the respective longitudinal axes thereof; and said first and second longitudinal axes are laterally offset.

5. A cap according to claim 4 wherein said intermediate section and said end section are cylindrical with said intermediate section having a larger transverse, cross-sectional diameter.

6. A cap according to claim 1 wherein said end section comprises a central portion terminating inside said piercer and a first portion extending radially outwardly from said central portion and opening on said circumferential surface at a first location.

7. A cap according to claim 6 wherein said end section comprises a second portion extending radially outwardly from said central portion, angularly spaced from said first portion and opening on said circumferentially surface at a second location spaced from said second location.

8. A cap according to claim 7 wherein said end section comprises a third portion extending radially outwardly from said central portion, angularly offset from said first and second portions and opening on said circumferential surface at a third location spaced from said first and second locations.

9. A cap according to claim 8 wherein said first, second and third portions are angularly offset by substantially equal angles.

10. A cap according to claim 1 wherein said dispensing means comprises dropper means.

11. A cap according to claim 1 wherein said inside end face of said second section is located at a transition from said first section to said second section;

said piercer is formed at a center of said inside end face.

12. A cap according to claim 1 wherein said intermediate section is cylindrical, and said flow channel comprises a frustonconical section extending from an end of said intermediate section remote from said end section and expanding in a discharge direction of said dispensing means.

13. A cap according to claim 12 wherein said second section comprises a semi-spherically rounded free end, said conical section opening on a center of said rounded free end.

14. A cap according to claim 1 wherein said coupling means of said first section comprises an inner thread conforming to and mating with an outer thread on the bottle neck.

15. A cap according to claim 1 wherein a closure part is removably coupled on said second section.

16. A cap according to claim 15 wherein said second section comprises an outer thread; and said closure part comprises a pot-shaped hood and has an inner thread mating with said outer thread of said second section.

17. A cap according to claim 15 wherein said closure part comprises a closed end with an inside surface and a plug formed at a center of said inside surface, said plug being sealingly introducible into said dropper dispensing means.

* * * * *